US005158034A

United States Patent [19]

Hsu

[11] Patent Number: 5,158,034

[45] Date of Patent: Oct. 27, 1992

[54] AUTOMATIC SWIMMING BOARD

[75] Inventor: Chi-Hsueh Hsu, Taipei Hsien, Taiwan

[73] Assignee: Tontech International Co., Ltd., Taipei, Taiwan

[21] Appl. No.: 840,274

[22] Filed: Feb. 24, 1992

[51] Int. Cl.[5] ..... B63C 11/46

[52] U.S. Cl. ..... 114/315; 440/6

[58] Field of Search ..... 114/315; 440/6

[56] References Cited

U.S. PATENT DOCUMENTS 3,442,240 5/1969 Wild et al. ..... 114/315
3,548,771 12/1970 Hastings ..... 114/315
3,618,551 11/1971 Desliewes ..... 114/315
3,650,234 3/1972 Goudy ..... 114/315

*Primary Examiner*—Jesus D. Sotelo
*Attorney, Agent, or Firm*—Morton J. Rosenberg; David I. Klein

[57] ABSTRACT

An automatic swimming board for a beginner to lie on for learning swimming or diving, has a transmitting unit to move forward the board by means of a motor powered by an electric power source for rotating fans, and a water pressure sensor and a pressure signal lamp to give a warning to the user about the depth limit when the board is used to dive in the water.

7 Claims, 4 Drawing Sheets

AUTOMATIC SWIMMING BOARD

BACKGROUND OF THE INVENTION

This invention concerns an automatic swimming board, which can be used for a beginner to learn swimming and diving, possible to move forward by means of a transmitting unit in which a motor is provided to rotate fans to move forward the board.

SUMMARY OF THE INVENTION

This invention has been devised to have the following functions.

1. It has transparent window to look down into water.
2. It has a water pressure sensor and a pressure signal lamp for preventing a user from falling into danger in diving.
3. It has a hidden motor which does not generate noise of high decibel (dB) and uses a battery to supply electric power to the motor, without any possibility to pollute sea water.
4. It has an anti-pollution net to prevent miscellaneous dirty matters from going in a fan cylinder to smear or bump fans.
5. It has multi-layer anti-leakage gaskets to prevent sea water from seeping into where transmitting unit is positioned to cause its disorder.

DETAILED DESCRIPTION OF THE INVENTION

Figure 1:
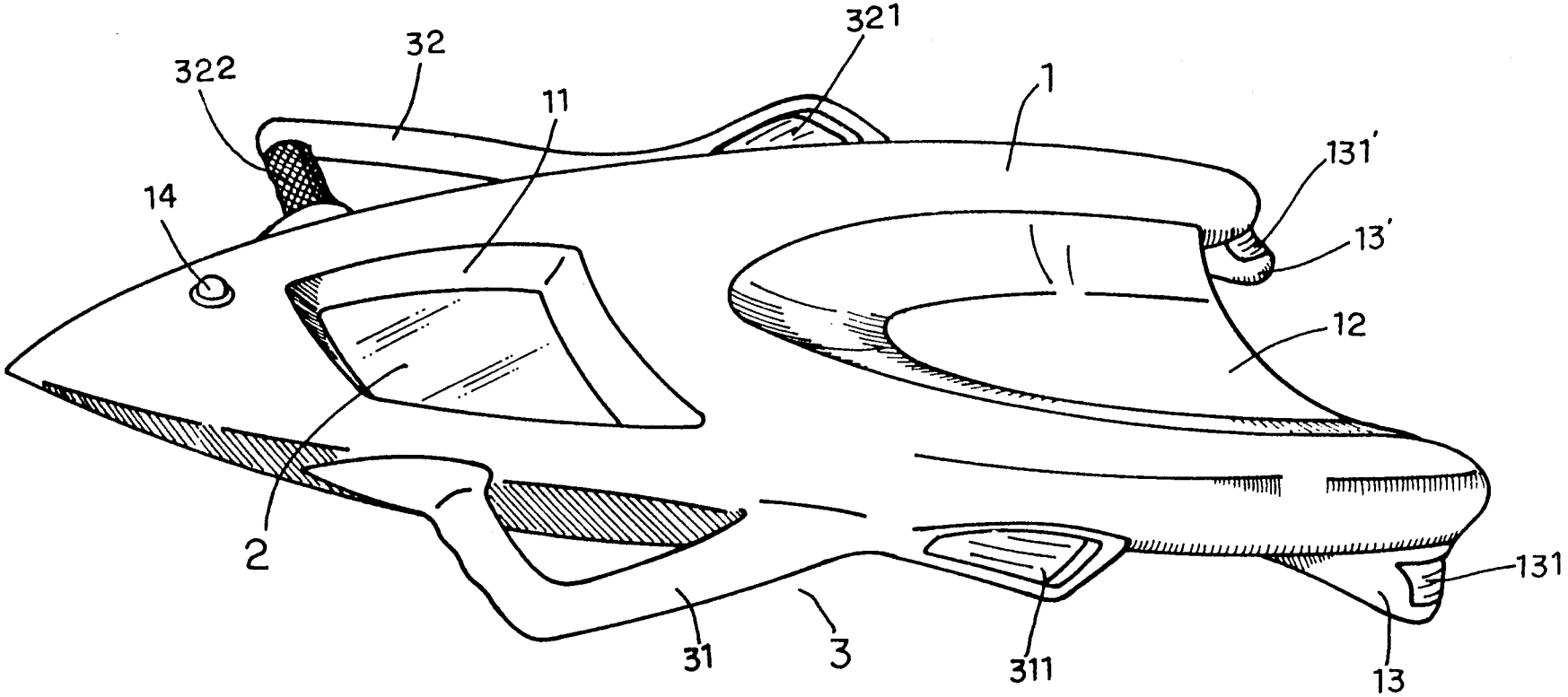
FIG. 1 is a perspective view of the automatic swimming board in the present invention.
Figure 2:
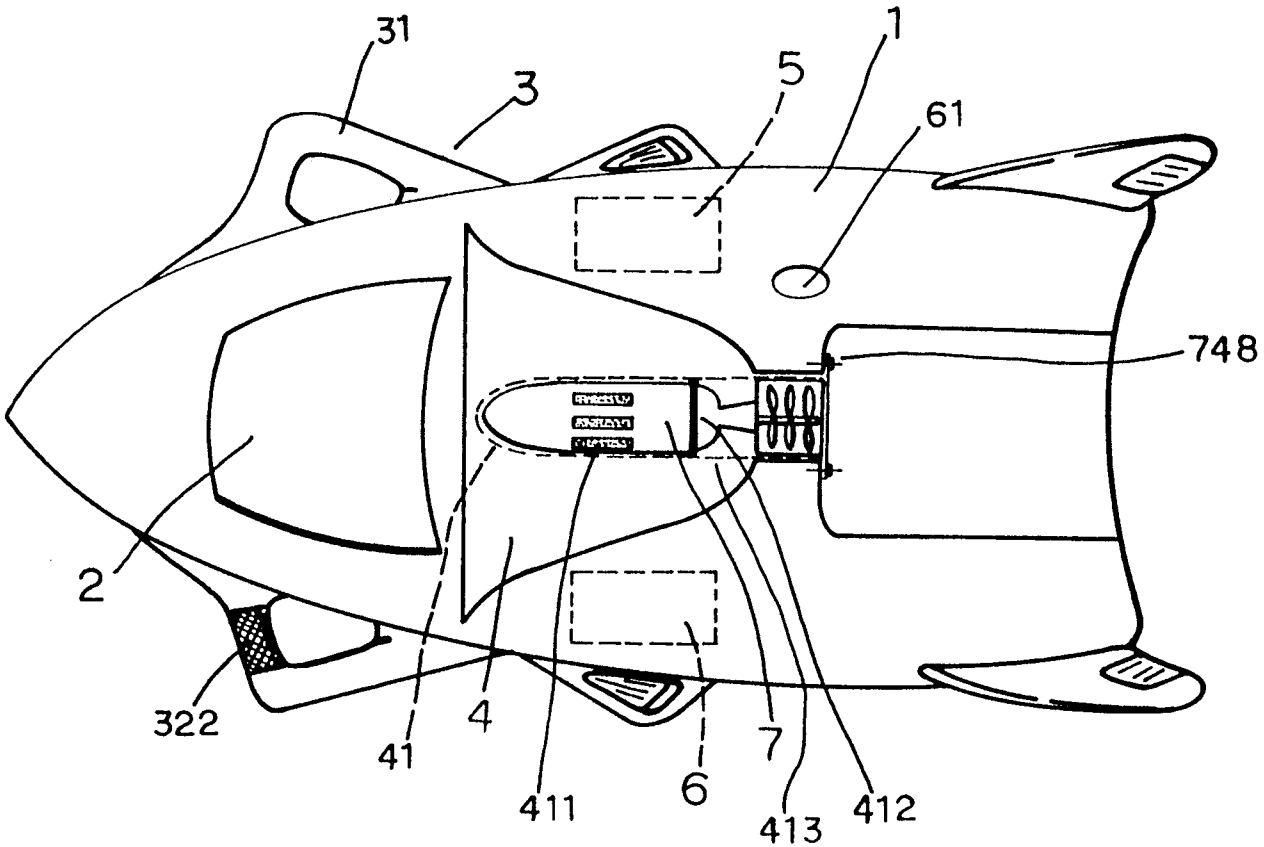
FIG. 2 is a bottom perspective view of the automatic swimming board in the present invention.
Figure 3:
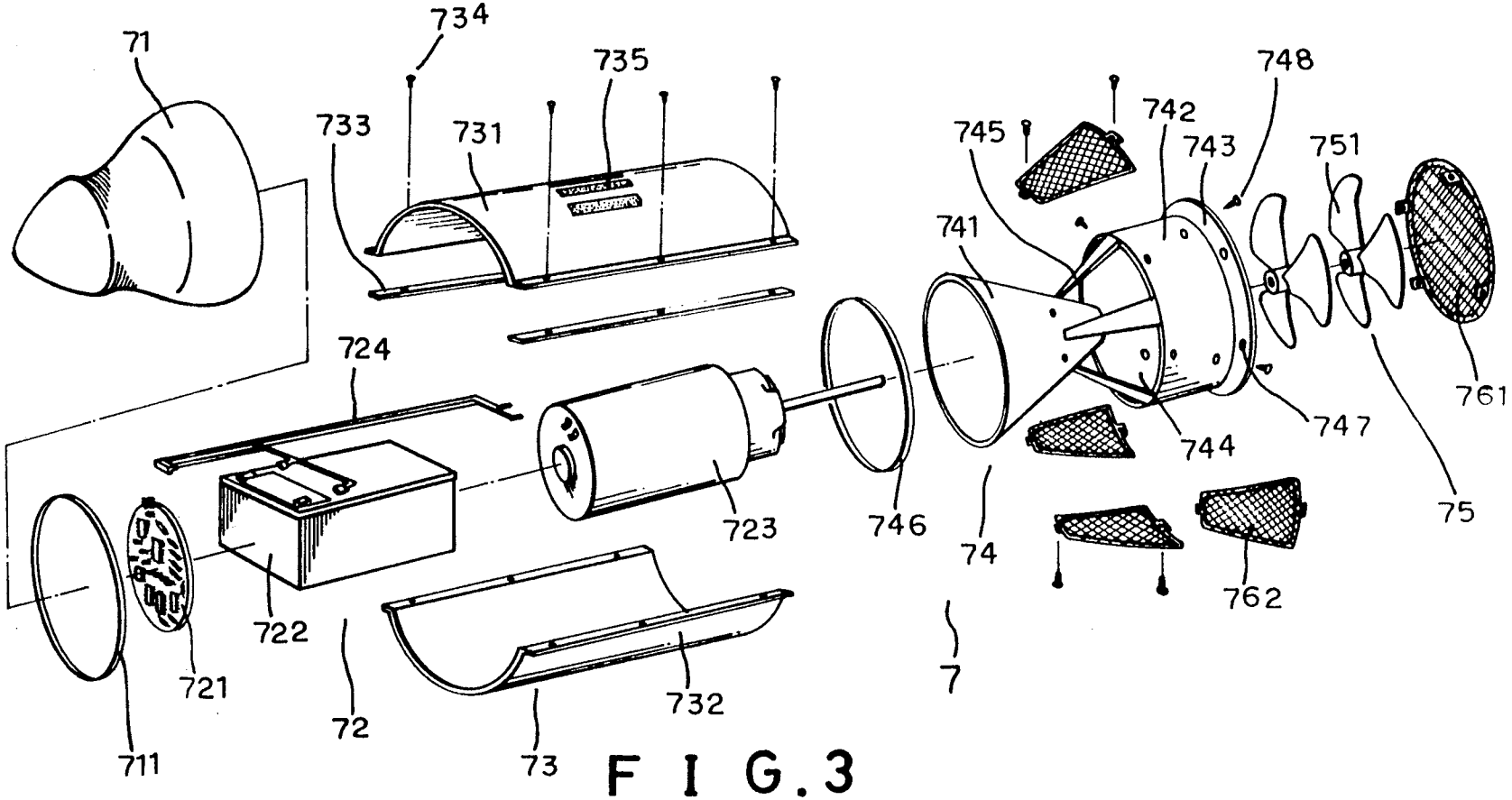
FIG. 3 is an exploded perspective view of the automatic swimming board in the present invention.

The automatic swimming board in the present invention, as shown in FIGS. 1, 2 and 3, comprises a body 1, a window 2, an operating handle 3, a current-guider 4, an electric power source 5, a wiring panel compartment 6, and a transmitting unit 7 as its main components.

The body 1 is shaped as streamlined, having a recess 11 in the front portion for setting the window 2, and recessed lying portion 12 at the rear portion for the abodomen of a user to lie on, two tail wings 131, 131' respectively fixed in two projection 13, 13' in both sides, and a water pressure signal lamp 14 in the front portion.

The window 2 is fixed in the recess 1, made of a transparent material so as to look through it down into water.

The operating handle 3 is formed as a unit with the body 1, consisting of an L-shaped left grip 31 and an L-shaped right grip 32 provided in both sides of the body 1. The right grip 32 has a net-shaped rotatable button 322. Two direction wings 311, 321 are respectively provided at both sides of the body 1, extending rearward from the rear end of the left or the right grip 31, or 32.

The current-guider 4 is shaped as a bell, fixed in a middle hollow in the bottom of the body 1.

The electric power source 5 is housed in a compartment beside the current guider 4, having a battery for supplying electric power to a battery 722 in a motor unit 72 in the transmitting unit 7 and for the water pressure sensor 61 and the pressure signal lamp 14.

The wiring panel compartment 6 is provided beside the current guider 4, and necessary wires are connected between the wiring panel and the water pressure sensor 61 and the signal lamp 14.

The transmitting unit 7 is inserted in a protective housing 41 positioned in the interior of the current guider 4, having a front cap 71, a motor unit 72, a side housing unit 73, a current sucker 74, a fan unit 75 and an anti-pollution net unit. An anti-leakage gasket 412 is provided in a gap between the housing 41 and the transmitting unit 7 to prevent sea water from going into the transmitting unit 7.

The front cap 71 is almost cone-shaped and the rear circumferential edge is connected with the side housing unit 73, with an anti-leakage gasket 711 pinched between the front cap 71 and the side housing unit 73.

The motor unit 72 consists of a control panel 721, a battery 722, a motor 723, and a conductive wire 724, orderly and partly placed inside the front cap 71. The conductive wire 724, the control panel 721, the battery 722 and the motor 723 are interconnected with one another to make up a circuit so that the motor 723 may get electric power from the battery 722, which is also connected with the battery in the electric power source 5.

The side housing unit 73 consists of an upper curved plate 731 and a lower curved plate 732 joined tightly together with screws 734 with an anti-leakage strip-like gasket 733 placed between them. The front end edges of both plates 731, 732 are connected with the rear edge of the front cap 71 so that the side housing unit 73 can protect the motor unit 72 along with the front cap 71.

Some conductors 735 are provided on the upper surface of the upper side plate 731 to contact with the conductive wire 724 and also to contact with polar plates 411 provided in the protective housing 41, and the polar plates 411 are connected with the output of the power source 5.

The current sucker 74 has a funnel-shaped cone 741 and a cylinder 742 connected together with a plurality of connecting rods 745 which define openings 744 apart between one another, and the cylinder 742 has a flange 743 at the rear end to combine with the board body 1 with screws. The front circumferential end of the cone 741 is connected with the rear circumferential end of the side housing unit 73 with an anti-leakage gasket 746 placed between. The flange 743 is bored with a plurality of holes 747 for screws to pass through to assemble the transmitting unit 7 with the board body 1.

The fan unit 75 has a plurality of fans 751 positioned to hide inside the cylinder 742, and is connected with the shaft of the motor 723 extending through the cone 741 and reaching the inside of the cylinder 742.

The anti-pollution net unit consists of a circular net 761 capped on the rear opening of the cylinder 742 and a plurality of quadrilateral nets 762 capped on the openings 744, preventing dirty matters in sea water from going into the cylinder 742 to bump or smear the fans 751.

Figure 4:
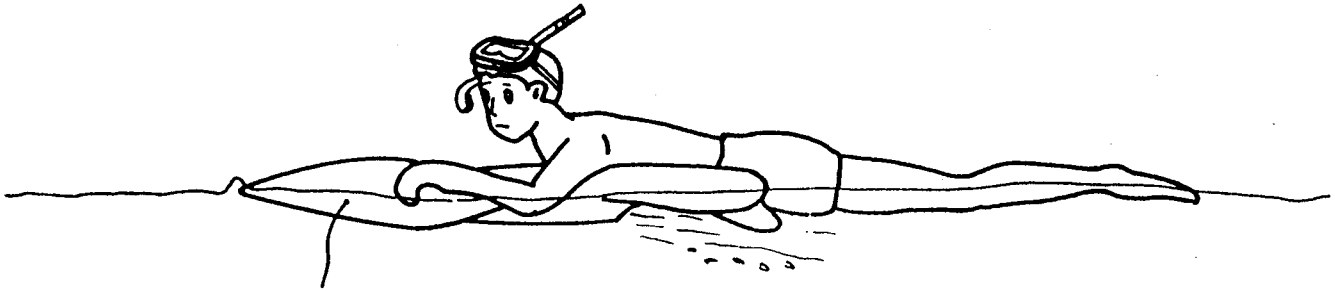
FIG. 4 is a perspective view of a user lying on the automatic swimming board moving forward on water in the present invention.

In using this board, referring FIG. 4, a user lies on it, with his face down and his upper body touching the recessed lying portion 12 and grips the left and the right grip 31 and 32 with his hands, operating the rotatable button 322 to control the propelling speed generated by the motor unit 72, permitting the body 1 to move forward on water. Then water can flow in through the current guider 4, then flowing through a plurality of holes 413 bored in the rear portion sides of the protective housing 41 and finally through the quadrilateral nets 762 capped on the openings 744 in the current sucker 74 so that the fan unit 75 may rotate at a great speed to suck the water current generating propelling power to push forward the body 1. Therefore, the water current coming from the forward direction can alleviate the power consumption of the motor 723 for rotating the fan unit 75.

When a user wants to change the moving direction of this board during swimming with it, he has to move his upper body to the left or the right, letting the gravitational center of his body to decline to the left or the right. At the same time, the tail wings 131, 132 can also help change the direction.

Figure 5:
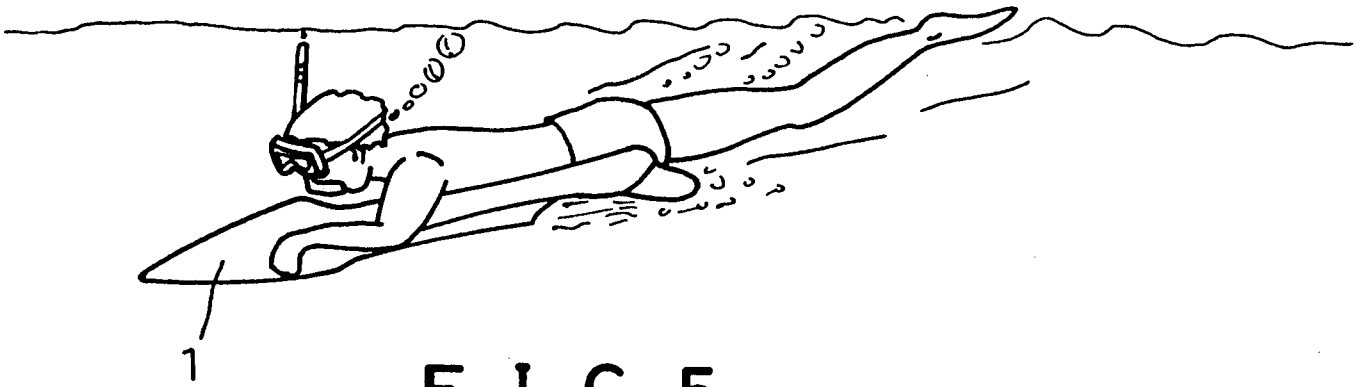
FIG. 5 is a perspective view of a user lying on the automatic swimming board and diving in water in the present invention.

When a user wants to make a diving with this board, referring to FIG. 5, he has to move forward his upper body on the board, letting the gravitational center of this body to move forward on this board, forcing this board to sink down in the water. And at the same time, the direction wings 311, 321 can help the board to sink down. When the board sinks down to the present depth to actuate the pressure sensor 61, the wiring panel in the panel compartment 6 will receive a signal issued by the sensor 61 to light up the pressure signal lamp 14, telling the user that he has reached enough depth, and should not go deeper.

The window 2 can be used to look down into the water to watch the condition of the sea bottom while a person is swimming with this board.

What is claimed is:

1. An automatic swimming board having a board body, a bell-shaped current guider fixed in a hollow under in its bottom side, a transmitting unit housed in protective housing provided in said current guider, and an electric power unit hidden in one side of said current guider, a wiring panel compartment provided in the other side of said current guider, a recessed rear lying portion in the board body for the upper body of a user to lie on with his face down, two downward projections joined with a tail wing at both sides of the end of the board body, a transparent window fixed in a recess in the front portion of said board body, a left and a right grip formed together with a left and a right direction wing at the left and the right side of said board body, said two grips being gripped by a user with his hands and the user controlling the water current speed generated by said transmitting unit in said current guider to move forward said board body and managing the moving direction of the board with his body moving to the left or the right, upward or downward.

2. The automatic swimming board as claimed in claim 1, wherein said transmitting unit comprises: a front cap shaped as nearly a hollow cone, having its rear circumferential edge fixed with an anti-leakage gasket;

a motor unit consisting of a control panel, a battery, a motor, and a conductive wire, all orderly and partly placed in said front cap, and said conductive wire connecting said control panel, the battery and the motor in a circuit to power the motor to rotate fans, and said battery also connected with said electric power source for charging;

a side housing unit consisting of an upper curved plate and a lower curved plate combined tightly together with anti-leadage strips pinched between them by means of screws, also combined with the front cap for housing the motor unit and having some conductors provided equally spaced apart on the outer surface of the upper curved plate, said conductors connected with the conductive wire in the motor unit;

a current sucker consisting of a funnel and a cylinder connected with the small diameter end of the funnel by means of connecting rods equally spaced apart, the front end of the funnel fixed around the inner surface of the side housing unit with an anti-leakage gasket pinched between, and the cylinder having at its rear end a flange bored with a plurality of holes for screws to pass through to fix the current sucker with the board body;

a fan unit consisting of several fans connected with the shaft of said motor and hidden in the cylinder in said current sucker, and the shaft of said motor extending through the funnel to reach in said cylinder;

an anti-pollution net unit consisting of a circular net to be capped on the rear opening of the cylinder and a plurality of quadrilateral nets capped on openings between each two connecting rods connecting said funnel with said cylinder; and said motor powered to rotate said fan unit to propel water back and thus to generate current force to move the board body and said anti-pollution net unit preventing miscellaneous dirty matters from going into the cylinder to smear or to bump against said fan unit.

3. The automatic swimming board as claimed in claim 1, wherein a protective housing shaped as a capsule is provided axially in said current guider to house said transmitting unit in its interior, having an opening in the rear end for pushing said transmitting unit in said protective housing, the rear end contacting the flange in the cylinder in said current sucker, said protective housing having several polar plates spaced apart to correspondingly contact with the conductors in said motor unit so as to supply the motor with electric power from the power source unit, and an anti-leakage gasket being provided in a gap between said protective housing and said transmitting unit.

4. The automatic swimming board as claimed in claim 1, wherein one of said grips is provided with a rotatable button having a net-shaped surface at the front portion of said grip.

5. The automatic swimming board as claimed in claim 1, wherein the wiring panel in said wiring panel compartment is connected with a water pressure sensor and a signal lamp in a circuit with electric wires.

6. The automatic swimming board as claimed in claim 1, wherein said window is made of a transparent material to look through.

7. The automatic swimming board as claimed in claim 3, wherein a plurality of openings are provided in the rear portion side of said protective housing near the anti-leakage gasket pinched in the gap between said protective housing and said transmitting unit.

* * * * *